US006334978B1

(12) United States Patent
DeYoung et al.

(10) Patent No.: US 6,334,978 B1
(45) Date of Patent: Jan. 1, 2002

(54) CAST ALLOYS

(75) Inventors: David H. DeYoung, Export, PA (US); Mark J. Dunlay, Newburgh, IN (US)

(73) Assignee: Alcoa, Inc., Pittsburgh, PA (US)

( * ) Notice: Subject to any disclaimer, the term of this patent is extended or adjusted under 35 U.S.C. 154(b) by 0 days.

(21) Appl. No.: 09/351,841

(22) Filed: Jul. 13, 1999

(51) Int. Cl.[7] ..... C22C 21/00

(52) U.S. Cl. ..... 420/529; 420/544; 420/542; 420/549

(58) Field of Search ..... 148/437, 440; 420/542, 549

(56) References Cited

U.S. PATENT DOCUMENTS 3,926,690 A * 12/1975 Morris et al. ..... 148/32
4,412,869 A * 11/1983 Vernam et al. ..... 148/2
4,412,870 A * 11/1983 Vernam et al. ..... 148/2
4,929,511 A * 5/1990 Bye, Jr. et al. ..... 428/606
5,571,347 A * 11/1996 Bergsma ..... 148/550
5,582,659 A * 12/1996 Hashimoto et al. ..... 148/549

FOREIGN PATENT DOCUMENTS

SU 928823 A1 * 2/1996

* cited by examiner

*Primary Examiner*—George Wyszomierski
*Assistant Examiner*—Janelle Combs-Morillo
(74) *Attorney, Agent, or Firm*—Charles Q. Buckwalter; Julie W. Meder; Edward L. Levine

(57) ABSTRACT

The present invention is directed to the additions of alkaline earth metals, in particular strontium and optionally combinations with other metals, to aluminum and aluminum alloys to improve the appearance of, eliminate surface imperfections, and reduce the surface oxidation of the as-cast ingots.

14 Claims, 4 Drawing Sheets

CAST ALLOYS

FIELD OF THE INVENTION

The present invention is directed to the improvement in the casting of aluminum and aluminum alloys and the products made therefrom by the addition of small quantities of strontium and/or alkaline earth, rare earth, and/or transition metal combinations.

BACKGROUND OF THE INVENTION

Since the introduction of the Hall process and its progeny, the commercialization of aluminum and aluminum alloys ("Alloys") has created a giant of an industry. In commercializing Alloys, it has been found that material properties such as strength, toughness and fatigue crack growth rates are important considerations in the final product, dependent upon product use.

Equally important, in many industries, to the physical properties entwined in Alloys is the physical appearance of the finished product. A cottage industry has grown up around the Alloy industry simply to make the Alloys look nice. Examples of such auxiliary industries are those created to manufacture methods to scalp an as-made ingot to rid the ingot of surface imperfections and/or edge cutters to rid the ingot of edge imperfections to name a few.

There are some imperfections in the casting of Alloys that can not be cured by cosmetic fixes. Some imperfections cause the cast piece to crack before it is worked. These are called various things by those skilled in the art and different companies have developed their own names for these imperfections. Such imperfections can include but are not limited to vertical folds, folds, pits, oxide patches, oxides or oxide clusters that become embedded in the surface in a solid ingot. A vertical fold is a V-shaped indentation in the surface of a rolling ingot that is oriented in the longitudinal direction of the ingot. Some vertical folds initiate cracking of the ingot. A cracked ingot needs to be re-melted and re-cast since such an ingot can not be further processed or sold to a downstream customer. Re-melting and Re-casting ingots is not only inconvenient but is also costly thereby reducing the efficiency of an Alloy mill. Most if not all ingots are worked in some manner, however, working will not heal a cracked ingot. Other surface imperfections may also serve as crack initiators. As is clear from the above, surface imperfections in ingots remain a problem in the Alloy art.

Working, as that term has become known in the Alloy industry, can mean a lot of different things such as but not limited to hot rolling, cold rolling, extruding, forgiving, drawing, ironing, heat treating, aging, forming, and stretching to name a few. In working or forming an Alloy, energy is put into the workpiece but it is not always homogeneously distributed.

The casting of Alloys may be promoted by any number of methods known to those skilled in the art. Examples of casting techniques are direct chill ("DC"), electromagnetic ("EMC"), horizontal direct chill ("HDC"), FDC casting, hot top casting, continuous casting, semi-continuous casting, die casting, roll casting, and sand casting. Each of these methods of casting has a set of its own inherent problems but with each technique, surface imperfections can still be an issue. Vertical folds are an issue with DC and EMC casting.

Alloys may comprise any of the Aluminum Association Registered Alloys such as the 1xxx, 2xxx, 3xxx, 4xxx, 5xxx, 6xxx, 7xxx, and 8xxx series alloys. The present invention would also be very useful for any of the foundry alloys. The present invention is found particularly useful for the 2xxx, 3xxx, 5xxx, 6xxx, and 7xxx series alloys. In particular, the addition of strontium and mixtures of strontium, the other alkaline earth metals, the rare earth series of elements and the transition elements it is found advantageous to add small quantities, no greater than 0.5 weight per cent in Alloys such as 2024, 2524, 3004, 5042, 5083, 5182, 6013, 6063, 7075, 7x55, and 7x50, to name a few. The additions hereof to Alloys is helpful after the Alloys are worked whether the Alloys are foil, sheet, stock plate, that is plate thicker than half an inch upwards to about 8 inches or more, aircraft skin, can body stock, end stock, and/or extrusions. It is found that the small additions made to the ingot also have other appearance enhancing effects that survive in a worked piece if the cast surface is not removed from the metal before working.

It has been found by the inventive addition of strontium that fewer oxides are created on the surface of the ingot. The significance of inhibiting the creation of certain of the defects to the ingot makes it possible to make a shallower scalp or perhaps not having to scalp at all. Scalping is the process of taking a surface layer off of the faces and sides of an ingot after it has solidified. The present invention provides for less alloy waste from the ingot if a shallower scalping is sufficient.

U.S. Pat. No. 5,469,911 addressed the surface quality issue in EM casting with the addition of small amounts of calcium to the alloy that was added prior to the ingot head. U.S. Pat. No. 4,377,425 addresses problems in DC casting through the use of similar amounts of calcium. Both claim to provide a surface free of many surface imperfections commonly associated with casting ingots but neither claim to be effective for a broad range of casting techniques. It is this across the board improvement in casting techniques that confounds the prior art.

The invention hereof has surprisingly shown that small amounts of strontium in Alloys can not only eliminate many surface imperfections, especially vertical folds, and pits but also enhances the reflectance of the Alloys. Additions of strontium and combinations are also found to reduce the oxidation of molten Alloys. Eliminating surface imperfections and reducing oxidation will increase product recovery at various process steps and thereby reduce production costs and increase the output of the production facility. Reducing oxidation will reduce losses of metal during melting, holding, and casting. This is known as melt loss. The invention is found to be useful in the canning and other container structures, transportation such as airplanes, trains, boats, and cars, as appearance of the metal may be found advantageous to the consuming public.

SUMMARY OF THE INVENTION

The present invention is directed to the addition of small amounts of strontium and optionally up to about 0.25 weight percent grain refiners, the remaining alkaline earth metals, transition metals, and/or rare earth metals in combination with aluminum and aluminum alloys as a melt in order to improve the appearance and/or substantially eliminate surface imperfections and/or reduce surface oxidation in cast ingot aluminum and aluminum alloys. The addition of the small amounts of these additives were found to surprisingly substantially eliminate vertical folds, pits and ingot cracking in more than one casting technique. The additions also improved the appearance of the ingots, including reflectance. As a result the ingots could be reduced or worked essentially right out of the casting without first conditioning the surface by, for example, scalping. The additions reduced the depth of lapping on DC cast ingots. The amount of strontium added can be as much as 0.50, 0.40, 0.30, 0.29, 0.25, or 0.15 weight percent but can be as little as 0.0001 weight per cent when combined with other metals and/or grain refiners. The range of strontium addition includes but is not limited to 0.001 weight per cent increments, such as 0.0011, 0.0012, 0.0013 etc. and includes but is not limited to incremental increases of 0.01 and 0.1 weight per cent. Optional combinations of strontium and alkaline earth elements such as magnesium, calcium, barium, or beryllium can be found to be useful as are additions of the rare earth metals such as holmium, cerium, erbium, lanthanum, and the other lanthanide and rare earth series of elements and some combination thereof, as well as small combinations of strontium and the transition metals such as titanium, scandium, and silver. It is found when combining strontium with the other aforementioned metals that it is preferred that the strontium combined additives have more strontium than the other mixed component metal. For example, it is preferred that strontium be present by at least more than 50% of what is being added. While this is preferred, smaller amounts of added strontium provide an operable improvement.

A surprising benefit was found when it was discovered that the alkaline earth, beryllium, could be omitted from a cast when there was a strontium or calcium addition either with or without grain refiners or a combination of grain refiners. Beryllium as an additive has become much maligned and in order to green the process of aluminum alloy casting it has been determined that excise of beryllium from the process is needed.

A surprising and significant part of the discovery of this invention is the reduction in the required depth of scalping. Normally, due to the creation of v-notches in the ingot surface, scalping of the ingot is required from a depth of 0.3 to 0.7 inches (0.76 to 1.8 mm). When determining the depth to scalp calipers or some measuring means such as with a laser, may be used to measure the lowest point on the ingot surface. Typically, this is the v-notch, which is the point, generally in the middle of the ingot where the ingot was not well formed. In the invention hereof, formation of the v-notch is inhibited and/or is essentially removed from the ingot face. Consequently, the scalped layer is substantially smaller. The scalped layer now is less than 0.3, 0.2, 0.1 inches or eliminated altogether. In addition, due to a substantially lessened oxide surface layer the need for scalping is further lessened to improve the surface of the ingot faces.

DETAILED DESCRIPTION

Figure 1:
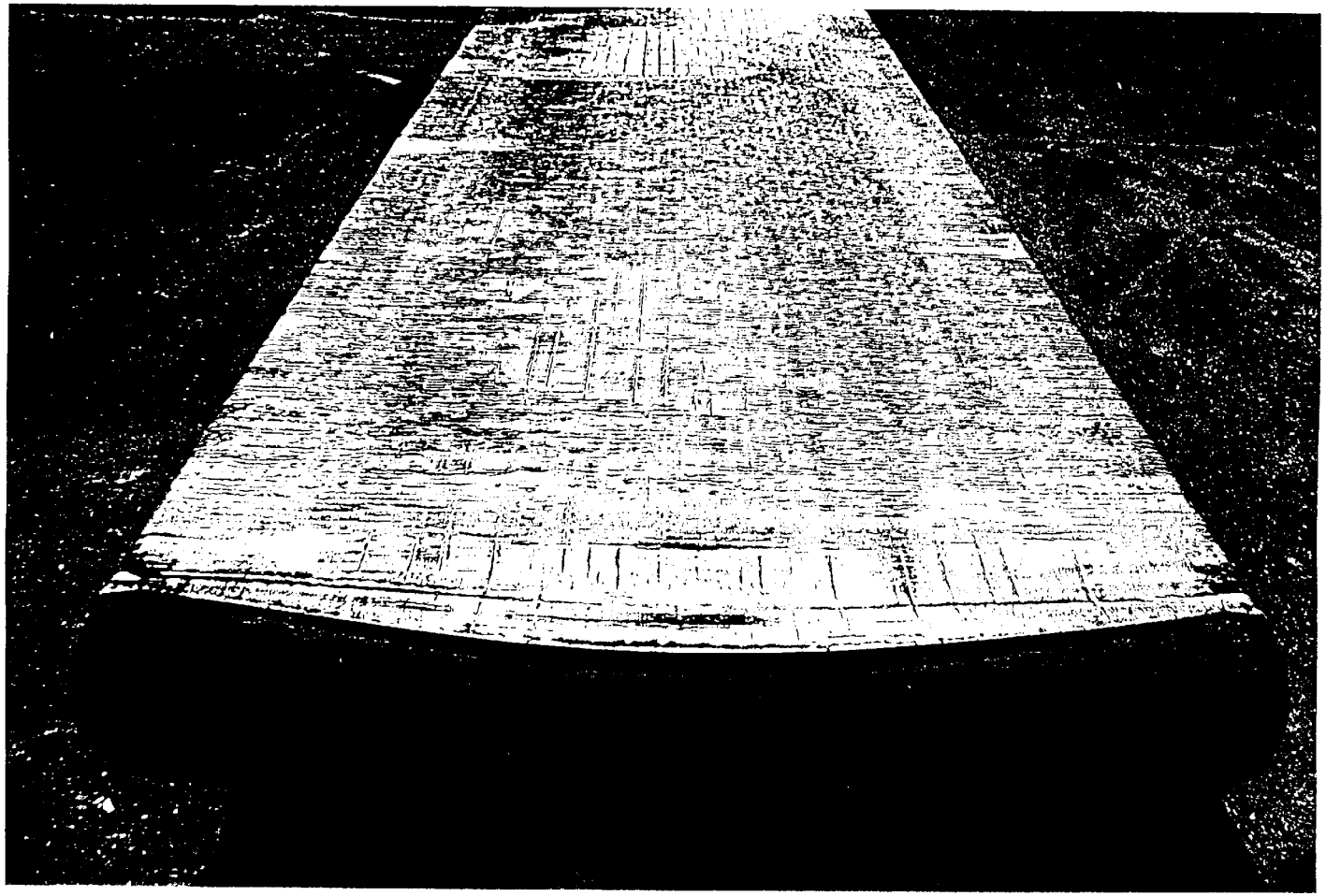
FIG. 1 is a picture of a DC cast ingot 5083 aluminum alloy without an additive change.

Having described the present embodiments, it is to be understood that the invention may be otherwise embodied within the scope of the appended claims. Strontium was added to a 5083 series alloy during DC casting. In the first series of examples, no addition was made in one cast and a strontium addition was made in four casts. Ingots of cross section 16 inches by 60 inches were vertically cast by the direct chill method or DC casting. The ingots were cast at a speed of 2 inches per minute and were typically cast to a length of 180 inches. Molten aluminum alloy flowed from a holding furnace through a trough and into a single stage in-line degassing unit known as the A622 process. Next, the alloy was flowed through a 30 pore per inch ceramic foam filter. The final step in casting flowed the molten alloy through a spout and into the ingot mold. In one cast no strontium was added to the metal, while in four other casts strontium was continuously fed into the degassing unit during the cast and thereby into the molten metal. The strontium is mixed in rod form comprising 15 weight per cent strontium and 85 weight per cent aluminum. As the melt is flowed through the feeding trough the strontium rod is added. The rod containing the 15 wt % strontium was fed into the molten aluminum alloy stream at a rate of 4, 8, 23, and 46 inches per minute. The nominal addition levels resulted in these four casts comprising 0.0035 wt %, 0.0070 wt %, 0.0200 wt %, and 0.0400 wt % strontium in the aluminum alloy.

Table 1 summarizes the ingots that were produced during these casts and provides a qualitative assessment of the ingot surface appearance.

TABLE 1

| Cast | Sr addition rate in/min | wt % Sr in ingot | ingot surface appearance |
|---|---|---|---|
| 1 | 0 | 0.0000 | Large patches with 12 inch folds on upper half. Ingot cracked out of small fold. |
| 2 | 4 | 0.0023 | Good surface, scattered 1 to 1.5 inch folds similar to ingots with higher Sr additions. |
| 3 | 8 | 0.0047 | Good surface, some 1 to 1.5 inch folds. |
| 4 | 23 | 0.026 | Good surface, some small 1 inch folds. |
| 5 | 46 | 0.045 | Good surface, some 1 inch folds. |

These test casts showed that even an addition of only 0.0023 wt % Sr inhibited the formation of large vertical folds and thereby deterring ingot cracking. Higher levels of strontium further reduce the number and size of the folds but with diminishing effects for the amount of strontium added.

Figure 2:
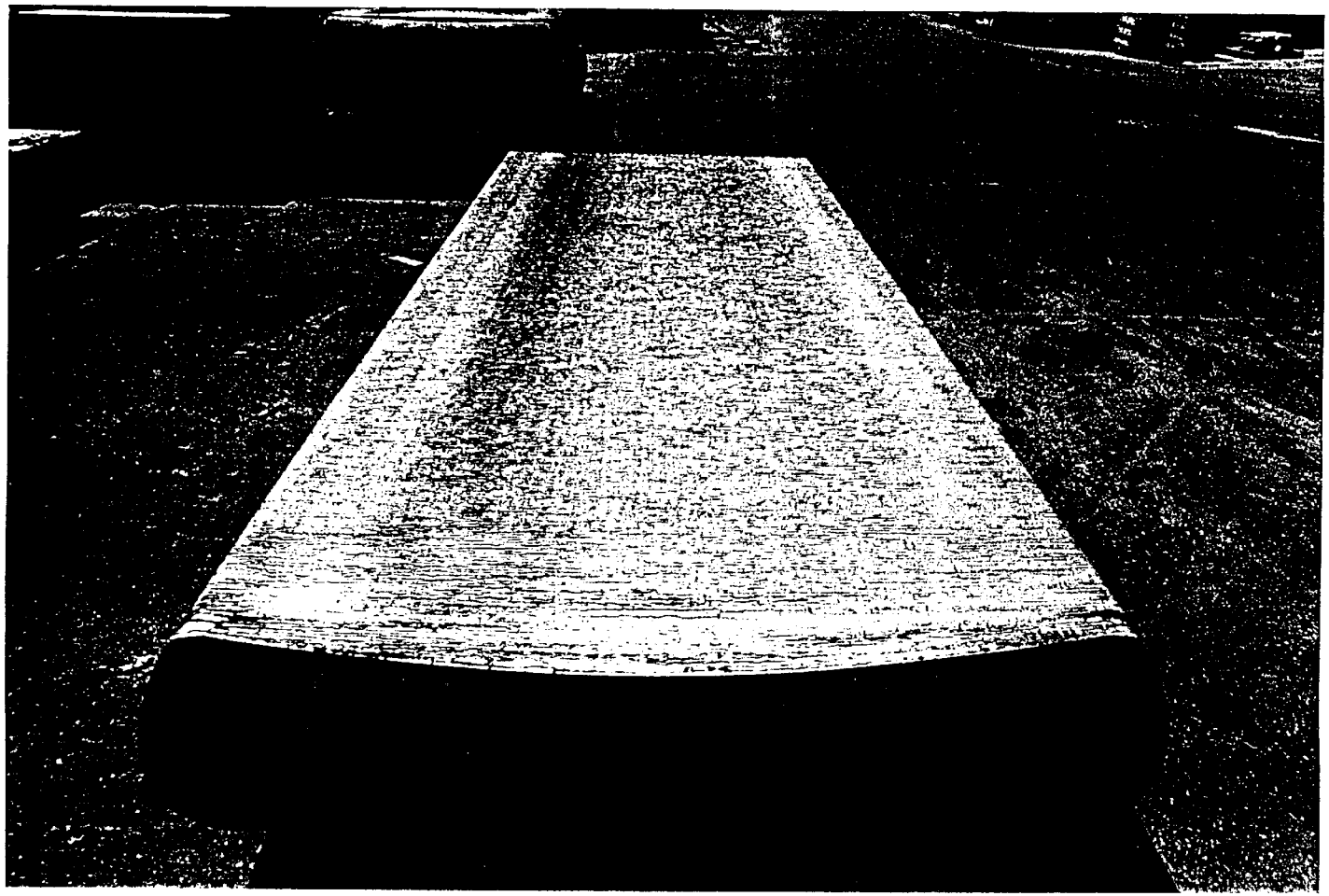
FIG. 2 is a picture of the same DC cast ingot 5083 aluminum alloy with the addition of 0.0023 weight per cent strontium.

In Table 1, the alloy cast was alloy 5083 as defined by the Aluminum Association designation. As can be seen from the comments in Table 1, the addition of very small amounts of strontium to the 5083 alloy have dramatic effects on inhibiting the formation of folds and thereby decreasing the risk of ingot cracking. The surface of ingots with strontium added were greatly improved as can be seen in the comparison of FIG. 1 and FIG. 2. FIG. 1 contains no strontium and exhibits many deep folds along the longitudinal axis. When the FIG. 1 ingot surface is compared with the FIG. 2 ingot surface the dramatic difference is evident at once. FIG. 2 is the same 5083 alloy as FIG. 1 except that strontium is present in the FIG. 2 ingot.

A second series of test castings were cast using the 5042 alloy and the EMC casting method. Casts were made with and without strontium. The amount of strontium levels in this series were 0.0035 wt %, 0.0150 wt %, 0.0200 wt %, and 0.0400 wt % strontium. Molten 5042 alloy was treated in single stage in-line degassing unit and a packed bed filter. Table 2 provides a summary of this series of test casts.

TABLE 2

| Cast | Sr addition rate in/min | % Sr in ingot | ingot surface appearance |
|---|---|---|---|
| 6 | 0 | 0.0000 | Numerous start folds and some long heavy steady state folds. |
| 7 | 8 | 0.0018 | A few start folds in transition area near ingot butt, no steady state folds on ingot. |
| 8 | 35 | 0.023 | no folds, good surface |
| 9 | 46 | 0.020 | no folds, good surface |
| 10 | 92 | 0.028 | no folds, good surface |

These results show that 0.0018 wt % Sr inhibited the production of steady state folds that can occur with EMC casting and at larger strontium additions inhibited the formation of substantially all the folds that may occur with EMC casting, both steady state folds and start folds. Steady state folds are folds that run most of the length of the ingot and generally occur near the center of the width. Start folds are folds that occur within the first 30 inches of ingot length, can occur almost anywhere across the width, and usually do not extend more that 30 inches from the ingot butt. The tendency for an ingot to crack from a steady state fold is greater than the tendency to crack from a start fold.

A third series of test casts were cast using the 7050 alloy. The ingots were produced using the DC casting technique. In these casts, the molten alloy was treated with a single stage degassing unit and flowed through a ceramic molten metal filter. Several casts were made without any strontium addition. The ingots exhibited small, deep folds or pits on the surface and both ingots cracked during casting as a result of the pits and folds. A cast of the same 7050 alloy was made whereby strontium was continuously added in the form of a rod of 15 wt % strontium, the remainder aluminum. The nominal wt % of strontium in the ingot was 0.022. A chemical analysis of this ingot revealed 0.027 wt % strontium in the ingot. These casts also showed that small amounts of strontium additions inhibit the formation of substantially all of the pits and folds on the surface thereby inhibiting the formation of cracks on the surface of the 7050 alloy.

Figure 3:
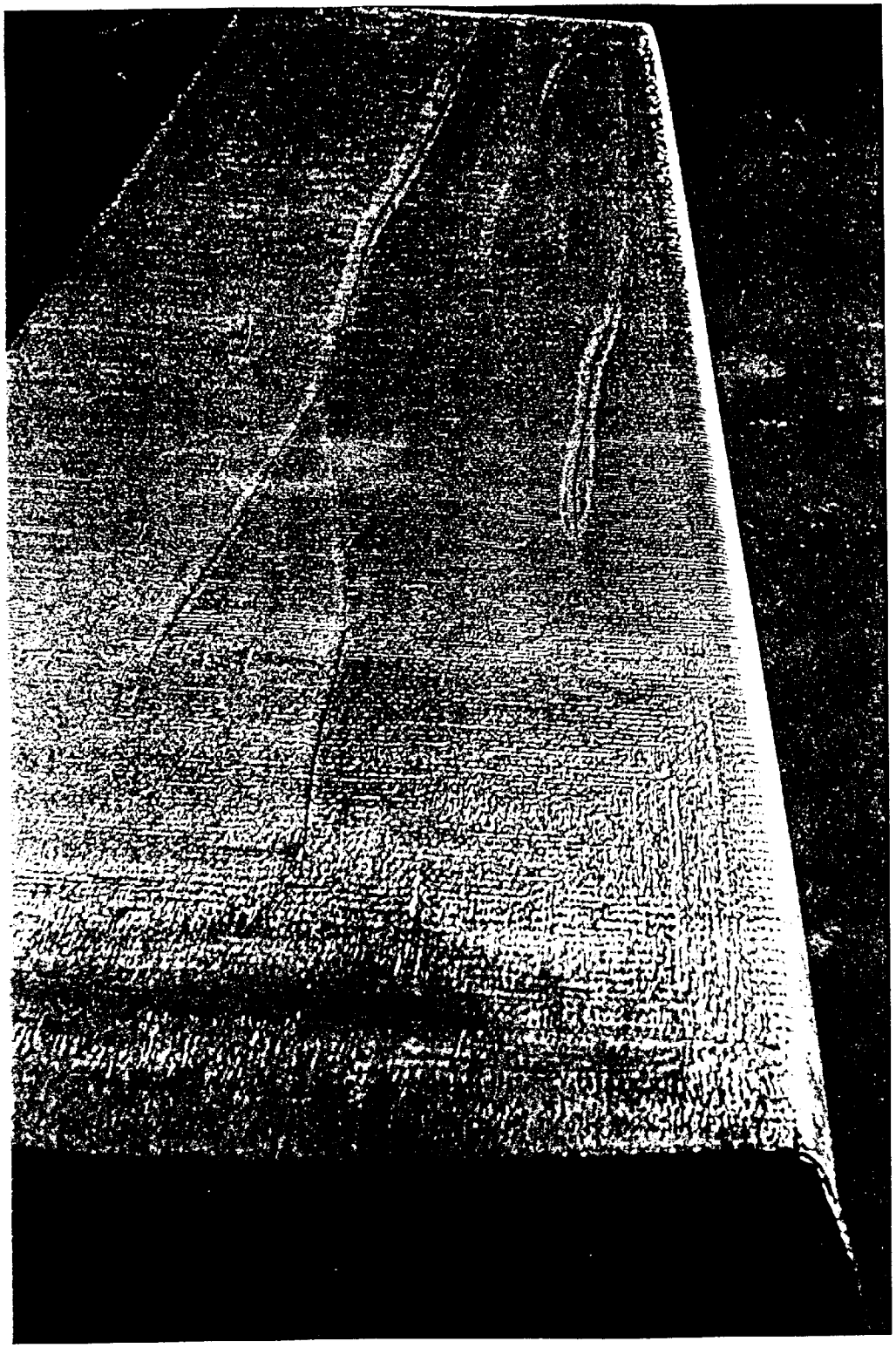
FIG. 3 is a picture of a DC cast ingot 7050 aluminum alloy without an additive change.

FIG. 3 shows the cracks on the surface of the ingot without any strontium added.

Figure 4:
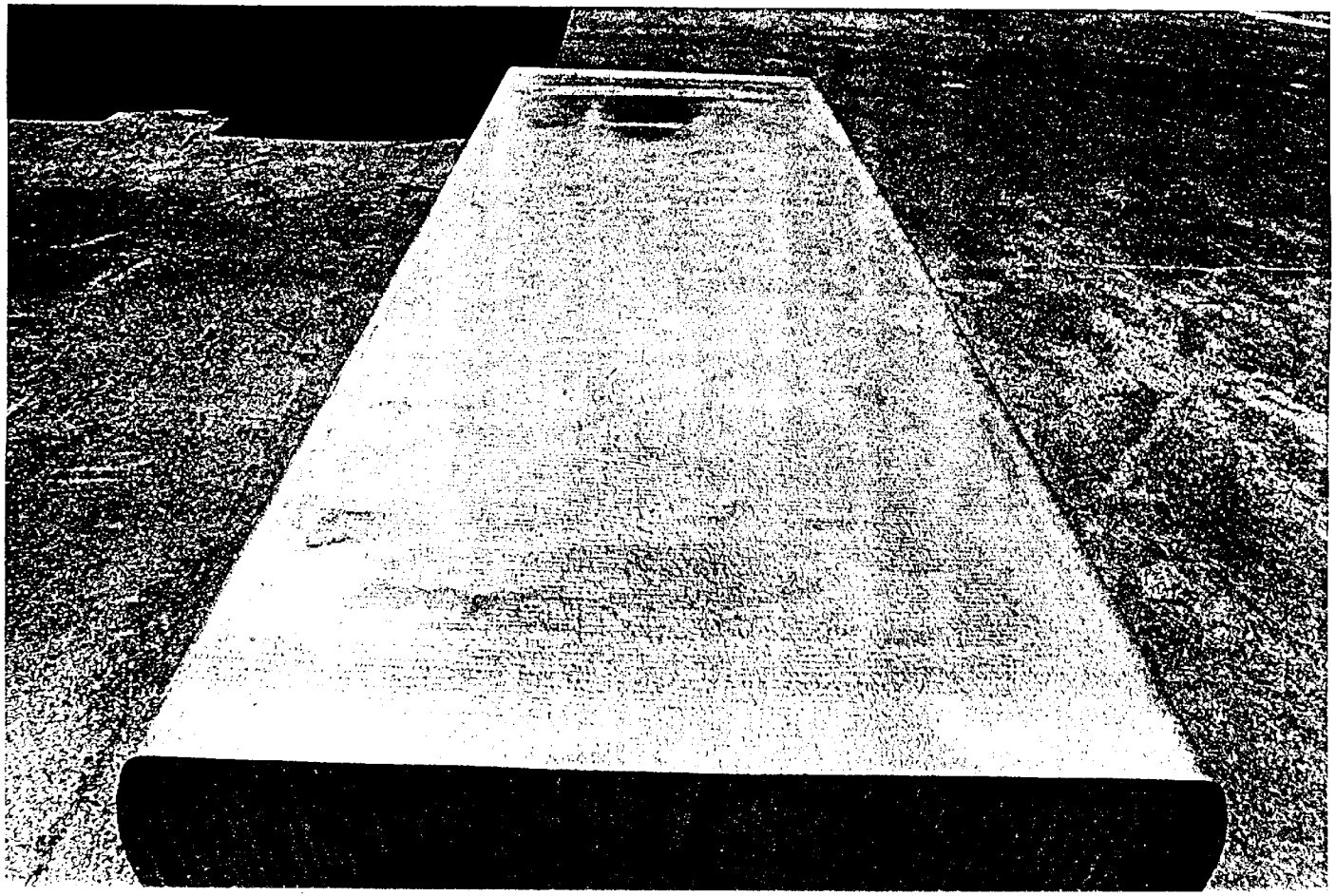
FIG. 4 is a picture of the same DC cast ingot 7050 aluminum alloy with the addition of 0.027 weight per cent strontium.

FIG. 4 shows the absence of cracks and pits for the 7050 ingot with strontium additions. It is clear that strontium has a dramatic effect on the surface of the as cast ingots when added in small amounts.

What is claimed is:

1. A single or plurality of aluminum and aluminum alloy cast ingots comprised of up to about 0.0001 to 0.0025 weight percent strontium and no more than 1.5 weight percent silicon, optionally combined with additives of up to about a total of 0.25 weight percent selected from the group consisting of alkaline earth, rare earth, transition metals and grain refiners, the remainder aluminum, incidentals and impurities and substantially beryllium free said aluminum selected from the group consisting of 2xxx, 5xxx, 7xxx series alloys wherein said strontium and additives improve the surface appearance, substantially inhibit surface imperfections, and reduce surface oxidation of said ingots.

2. The ingots of claim 1 wherein said imperfections are v-notches, folds, vertical folds, pits, oxide patches, and ingot cracking.

3. The ingots of claim 1 wherein said ingots are cast by the casting method selected from the group consisting of direct chill, electromagnetic, horizontal direct chill, level pour casting, round ingot casting, sheet ingot casting, continuous casting, semi-continuous casting, die casting, and sand casting.

4. The ingots of claim 1 wherein said alloys are selected from the group consisting of 2024, 2524, 5042, 5083, 5182, 7050, 7075, 7x55, and 7x50 series alloys.

5. The ingots of claim 1 wherein said ingots are comprised of at least 0.001 weight percent strontium.

6. The ingots of claim 1 wherein said ingots contain at least one alkaline earth selected from the group consisting of magnesium, calcium, and barium.

7. The ingots of claim 1 wherein said ingot contain at least one rare earth metal selected from the group consisting of cerium, erbium, lanthanum, or some combination thereof.

8. The ingots of claim 1 wherein said transition metals are selected from the group consisting of titanium, scandium, and silver.

9. The ingots of claim 1 wherein said alloys contain greater than 0.1 weight per cent magnesium.

10. The ingots of claim 1 wherein the surface of the ingot is scalped to less than 0.3 inches.

11. The ingots of claim 1 wherein the surface of the ingot is scalped to less than 0.2 inches.

12. The ingots of claim 1 wherein the surface of the ingot is scalped to less than 0.1 inches.

13. The ingots of claim 1 wherein the surface is not scalped.

14. A single or plurality of aluminum alloy cast ingots comprised of up to about 0.0001 to less than 0.005 weight percent strontium, not more than 1.5 weight percent silicon, optionally combined with additives of up to a total of 0.25 weight percent selected from the group consisting of alkaline earth, rare earth, transition metals and grain refiners, the remainder aluminum, incidentals and impurities, and substantially beryllium free said aluminum alloy consisting of the 6xxx series alloys wherein said strontium and additives improve the surface appearance, substantially inhibit surface imperfections and reduce surface oxidation of said ingots.

* * * * *